US007843389B2

(12) United States Patent
Luk et al.

(10) Patent No.: US 7,843,389 B2
(45) Date of Patent: Nov. 30, 2010

(54) COMPLEMENTARY WIDEBAND ANTENNA

(75) Inventors: Kwai-Man Luk, Kowloon (HK); Hang Wong, Kowloon (HK)

(73) Assignee: City University of Hong Kong, Kowloon (HK)

( * ) Notice: Subject to any disclaimer, the term of this patent is extended or adjusted under 35 U.S.C. 154(b) by 1042 days.

(21) Appl. No.: 11/373,518

(22) Filed: Mar. 10, 2006

(65) Prior Publication Data

US 2007/0210976 A1 Sep. 13, 2007

(51) Int. Cl.
*H01Q 1/38* (2006.01)
*H01Q 9/16* (2006.01)

(52) U.S. Cl. ..... 343/700 MS; 343/793; 343/795; 343/846

(58) Field of Classification Search ..... None
See application file for complete search history.

(56) References Cited

U.S. PATENT DOCUMENTS 6,400,321 B1 * 6/2002 Fenwick et al. ..... 343/700 MS
6,593,887 B2 7/2003 Luk et al. ..... 343/700
6,982,673 B2 * 1/2006 Yuanzhu ..... 343/700 MS
7,109,921 B2 * 9/2006 Leelaratne ..... 343/700 MS
7,148,847 B2 * 12/2006 Yuanzhu ..... 343/700 MS
7,161,540 B1 * 1/2007 Liu ..... 343/700 MS
7,304,611 B2 * 12/2007 Yuanzhu ..... 343/700 MS
7,446,707 B2 * 11/2008 Poe et al. ..... 343/700 MS
2006/0181475 A1 * 8/2006 Kwon et al. ..... 343/793
2008/0198085 A1 * 8/2008 Hsu et al. ..... 343/795
2009/0079654 A1 * 3/2009 Higaki et al. ..... 343/795

* cited by examiner

*Primary Examiner*—Trinh V Dinh
(74) *Attorney, Agent, or Firm*—Heslin Rothenber Farley & Mesiti P.C.

(57) ABSTRACT

A complementary wideband antenna includes a planar dipole formed of two dipole sections and a shorted patch antenna located between the dipole sections, the dipole sections being spaced above a ground plane. A variety of different feed probe designs can be used to excite the antenna. The complementary wideband antenna has electrical characteristics including low back radiation, low cross polarization, a symmetrical radiation pattern, and is stable in gain and radiation pattern shape over the frequency bandwidth.

21 Claims, 15 Drawing Sheets

COMPLEMENTARY WIDEBAND ANTENNA

FIELD OF THE INVENTION

This invention relates to a wideband antenna, and in particular to a complementary wideband antenna comprising a planar dipole and a shorted patch antenna.

BACKGROUND INFORMATION

The success of second generation (2G) mobile phones has motivated and enhanced the development of a wide range of wireless technologies, including for example 3G video phones, WiFi, WIMAX, ZigBee and Bluetooth. For cost effectiveness and space utilization wideband antennas that can accommodate several different communication systems are in high demand. In particular, antennas with unidirectional radiation patterns of various beam widths are of interest as they may be mounted on walls or vehicles without degrading their electrical characteristics and without affecting the aesthetics of the mounting bodies.

There are a number of techniques available for implementing wideband antennas with a unidirectional radiation pattern. The first approach is to put a dipole in front of a finite ground plane. However, since the size of the ground plane and the distance between the ground plane in terms of wavelength are frequency dependent, the antenna the disadvantages of large variations in gain and beam width over the operating band, different beam widths in the E and H planes, and strong radiation in the back side.

The second approach is through the use of patch antennas. The basic structure of a patch antenna is low in profile and has a unidirectional beam pattern, but is narrow in bandwidth. Several designs are now available to increase the bandwidth of patch antennas, such as U.S. Pat. No. 6,593,887 which describes a patch antenna with an L-shaped probe feed that is simple in structure and very wide in bandwidth. However, this class of patch antennas has the drawbacks of high cross-polarization, large variations in gain and beam width over the operating band, different beam widths in the E and H planes, and very strong radiation in the back side.

The third approach is to design an antenna consisting of a combination of an electric dipole and a magnetic dipole, commonly called a complementary antenna. It has been shown that if two complementary radiating elements of equal amplitude are combined properly in phase and orientation, the resulting radiation pattern will be equal in the E and H planes and the back lobe will be zero in strength, known as "cardioid" pattern shape. This concept has been realized in slot-and-dipole combinations where the slot is equivalent to a magnetic dipole in radiation, but the resulting designs are either narrow in bandwidth or bulky in structure.

SUMMARY OF THE INVENTION

According to the invention there is provided a wideband antenna comprising a planar dipole formed of two dipole sections and a shorted patch antenna located between said dipole sections, said dipole being spaced above a ground plane.

In a preferred embodiment of the invention the shorted patch antenna comprises first and second parallel vertical sections extending respectively from an edge of a respective dipole section to the ground plane.

A feed probe is preferably located between the vertical sections of the shorted patch antenna which feed probe may take a number of possible forms. For example, in one embodiment the feed probe comprises a first section extending vertically with respect to the ground plane parallel and proximate to the first vertical section of the shorted patch antenna, a second section extending parallel to the ground plane, and a third section extending towards the ground plane. In this embodiment preferably the second section is spaced from the ground plane by the same distance as the planar dipole sections. In this embodiment, preferably the third section extends proximate and parallel to the second vertical section of the shorted patch antenna or at a small angle thereto.

In an alternative embodiment the feed probe comprises a coaxial feed extending from the ground plane substantially to the spacing of the dipole sections from the ground plane, and a probe comprising a portion extending parallel to the ground plane and a portion extending towards the ground plane and substantially perpendicular thereto.

In a further alternative embodiment the feed probe comprises a microstrip transmission line extending from the ground plane substantially to the spacing of the dipole sections from the ground plane, and a probe comprising a portion extending parallel to the ground plane and a portion extending towards the ground plane and substantially perpendicular thereto.

In a still further alternative embodiment the feed probe comprises a first section extending perpendicularly to the ground plane and parallel to the first vertical section, and a second section extending parallel to the ground plane, the second section having a T-shape.

In another possible embodiment, the feed probe comprises a first section extending perpendicularly to the ground plane and parallel to the first vertical section, a second section extending parallel to the ground plane, and two vertical sections extending from the second section towards the ground plane.

The dipole sections may take a number of different shapes, for example they may be rectangular, polygonal, triangular or semi-circular.

To reduce the size of the antenna and in particular to reduce the spacing of the dipole sections from the ground plane, dielectric material may be provided in a space defined by the shorted patch antenna.

Preferably the dipole sections are planar and parallel to the ground plane. To reduce the size of the antenna however at least a portion of each said dipole section is angled relative to said ground plane and preferably the whole dipole section is planar but angled towards the ground plane. Alternatively each dipole section may comprise a portion parallel to the ground plane and a portion perpendicular to the ground plane.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

Figure 1A:
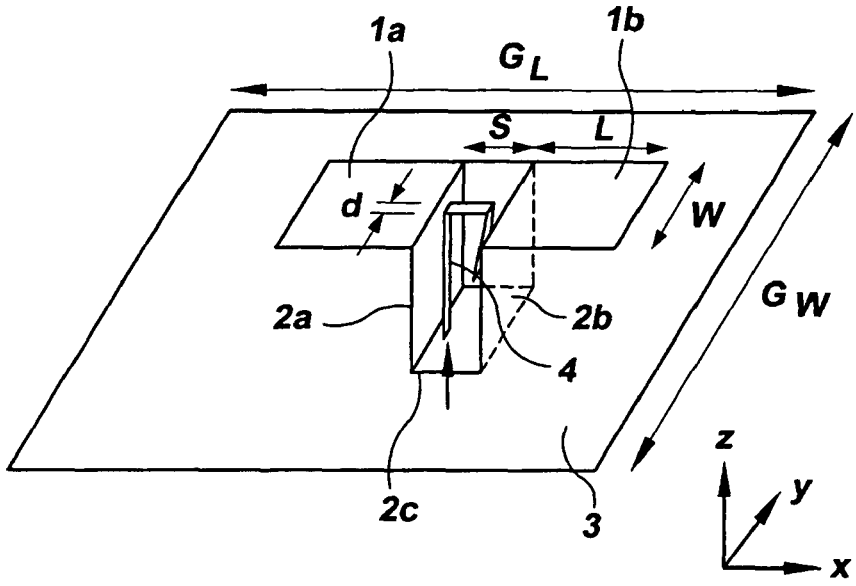
FIGS. 1(*a*) and (*b*) are (*a*) perspective and (*b*) side views of one example of an antenna according to an embodiment of the invention, FIGS. 2(*a*) and (*b*) show (*a*) measured and simulated SWR against frequency and (*b*) measured and simulated gain against frequency for the antenna of FIG. 1, FIGS. 3(*a*)-(*c*) show measured radiation patterns for one example of an embodiment of the invention at (*a*) 1.75 GHz, (*b*) 2.5 GHz and (*c*) 3.0 GHz, FIGS. 4(*a*) and (*b*) show side views of example alternative possibilities for a feed comprising either (*a*) a coaxial feed or (*b*) a microstrip line feed, FIGS. 5(*a*)-(*c*) show top and side views of example embodiments of the invention with (*a*) a T-shaped coupling feed, (*b*) a capacitive coupling feed, and (*c*) an F-shaped coupling feed.
Figure 1B:
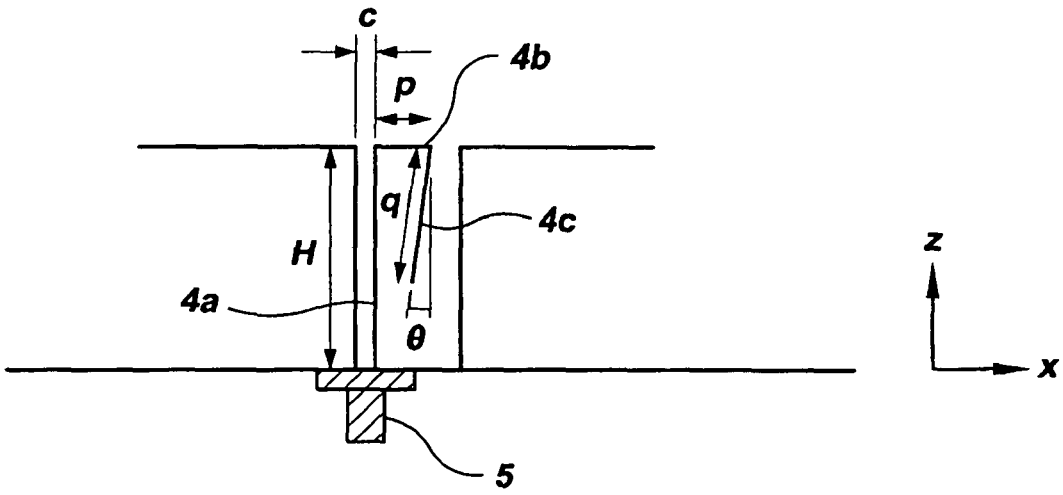

Referring firstly to FIG. 1 there is shown one example of a complementary wideband antenna according to an embodiment of the invention with FIG. 1 (*a*) being a perspective view and FIG. 1(*b*) a side view. In the embodiment of FIG. 1 the antenna comprises a horizontal rectangular planar dipole formed by dipole sections 1*a* and 1*b* connected to the open end of a vertically-oriented shorted patch antenna comprising vertical sections 2*a*, 2*b* and horizontal section 2*c*. A ground plane 3 is located beneath the antenna for back lobe reduction. In the embodiment of FIG. 1 the horizontal section 2*c* of the shorted patch antenna is an integral part of the ground plane 3 located between the vertical sections 2*a*, 2*b* but the section 2*c* could be an individual connecting section separate from the ground plane (see FIG. 9 below for examples). The function of the horizontal section 2*c* is to connect the vertical sections 2*a*, 2*b* so that they are electrically short-circuited. Vertical sections 2*a*, 2*b* are generally parallel to each other but the skilled person will understand that they may be slightly non-parallel, ie sloping towards or away from each other by a few degrees.

Each dipole section 1*a*, 1*b* is a rectangle having a width W and a length L. The width W is approximately equal to 0.5λ (where λ is the intended operating wavelength) and the length L is approximately equal to 0.25λ. The spacing of the dipole sections 1*a*, 1*b* and the height H of the shorted patch antenna is also approximately 0.25λ. For wideband operation the separation S of the vertical sections 2*a*, 2*b* of the shorted patch antenna is approximately 0.1λ. The size of the back plane can be adjusted for low back radiation, but a typical size $G_W \times G_L$ is 1λ×1λ. The dipole sections 1*a*, 1*b* and the patch antenna may be formed of a suitable conducting material such as copper plate.

The antenna as described above may be excited in a number of different ways. The excitation method shown in FIGS. 1(*a*) and (*b*) uses a Γ-shaped probe feed 4 comprising a vertical first portion 4*a*, a horizontal second portion 4*b*, and a third portion 4*c* formed by folding a straight metallic strip of rectangular cross-section into the desired Γ shape. Vertical first portion 4*a* has one end connected to a coaxial launcher 5 mounted below the ground plane 3. This portion acts as an air microstrip transmission line which transmits an electrical signal from the coaxial launcher 5 to the second portion 4*b* of the feed 4. Vertical portion 4*a* is parallel to the vertical portion 2*a* of the patch antenna and spaced therefrom by a small amount c such as approximately 0.008λ. The second portion 4*b* is horizontally located and serves to couple the electrical energy to the planar dipole and the shorted patch antenna. The input resistance of the antenna is controlled by the length p of this second portion so the length of the second portion 4*b* has to be selected accordingly. Typically p may be approximately 0.07λ. The second portion 4*b* itself acts as an inductive reactance which can cause the antenna to be mismatched, but the third portion 4*c* in combination with patch antenna vertical portion 2*b* forms an open circuit transmission line with the equivalent circuit of this line being a capacitor. By selecting the appropriate length q for the third portion 4*c* (eg approximately 0.18λ) the capacitive reactance can be used to compensate for the inductive reactance caused by the second portion 4*b*. The third portion is preferably parallel to vertical patch antenna portion 2*b*, but may be angled thereto slightly as shown in FIG. 1(*b*) where third portion 4*c* is at an angle θ to the vertical.

Typical dimensions (in mm and as wavelength fractions) for the antenna structure of FIG. 1 are given below in the event of an operating center frequency of 2.5 GHz.

| p | q | c | d | H | $G_L$ | $G_W$ | L | S | W | θ |
|---|---|---|---|---|---|---|---|---|---|---|
| 9.5 | 22 | 1 | 4.911 | 30 | 120 | 120 | 30 | 17 | 60 | 0 |
| 0.07λ | 0.18λ | 0.008λ | 0.04λ | 0.25λ | λ | λ | 0.25λ | 0.14λ | 0.5λ | |

Figure 2A:
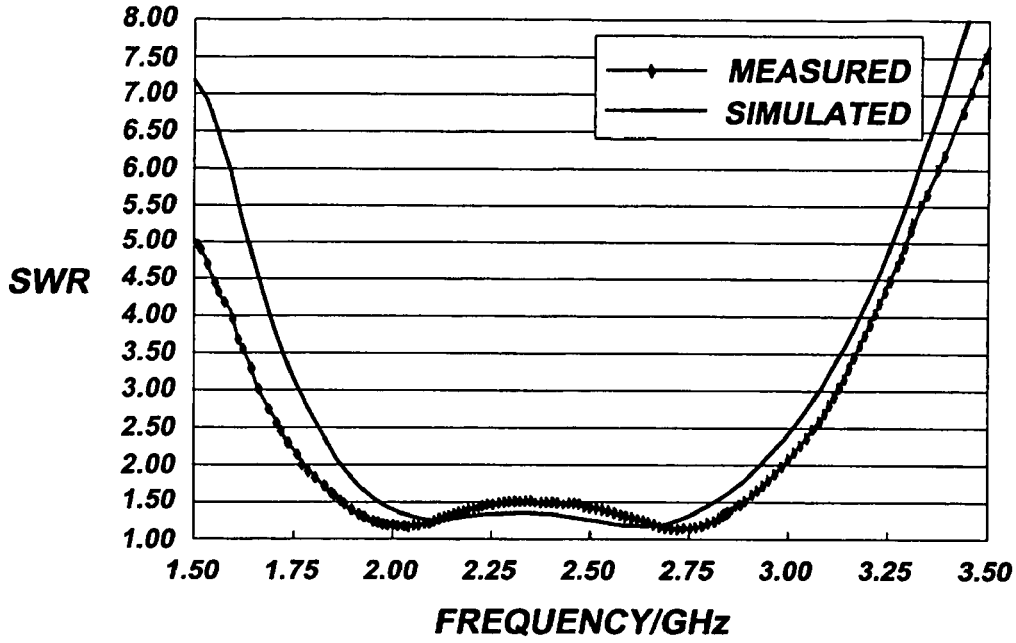
Figure 2B:
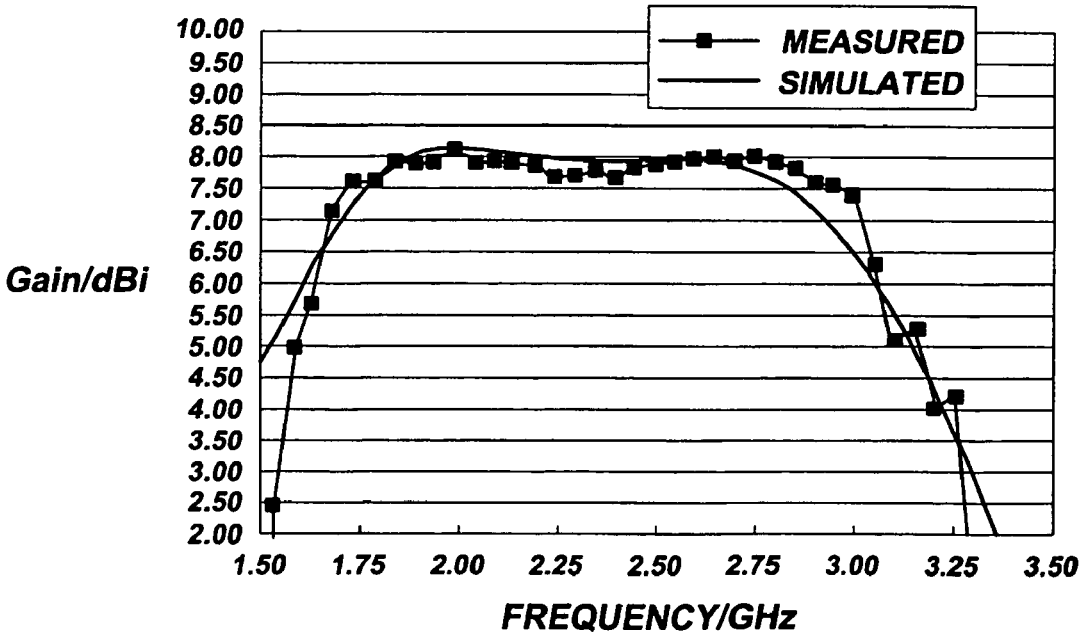

FIGS. 2(*a*) and (*b*) show (*a*) the standing wave ratio (*SWR*) and (*b*) gain as a function of frequency for the antenna of FIG. 1. Both FIGS. 2(*a*) and (*b*) show both measured and simulated results which show good agreement. It can be seem from FIGS. 2(*a*) and (*b*) that the antenna has a wide impedance bandwidth of 52% (with *SWR* less than 2 from 1.75 GHz to 3.0 GHz) and an average gain of 8 dBi varying from 7.5 dBi to 8.2 dBi which is quite a small variation.

Figure 3A:
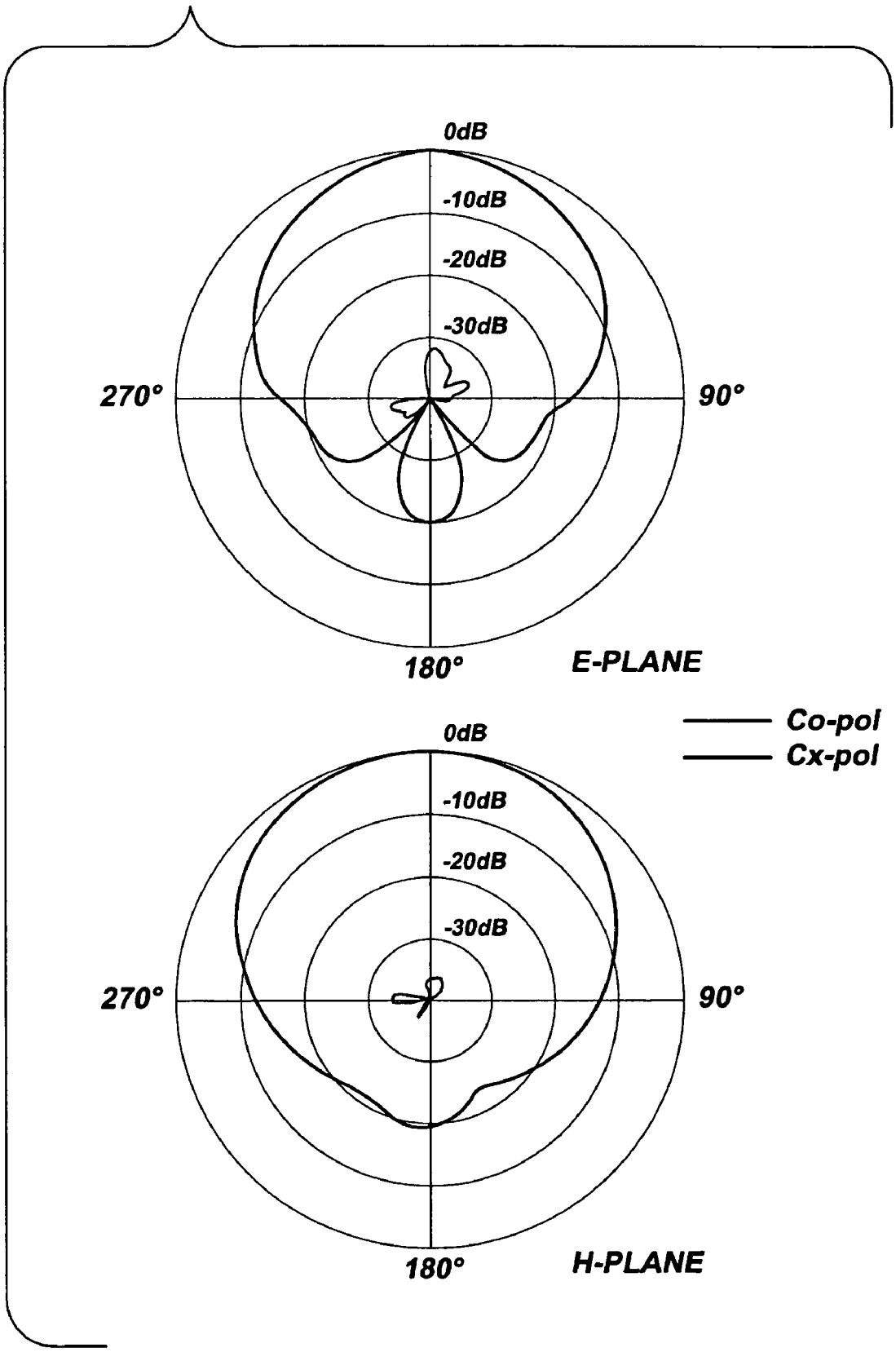
Figure 3B:
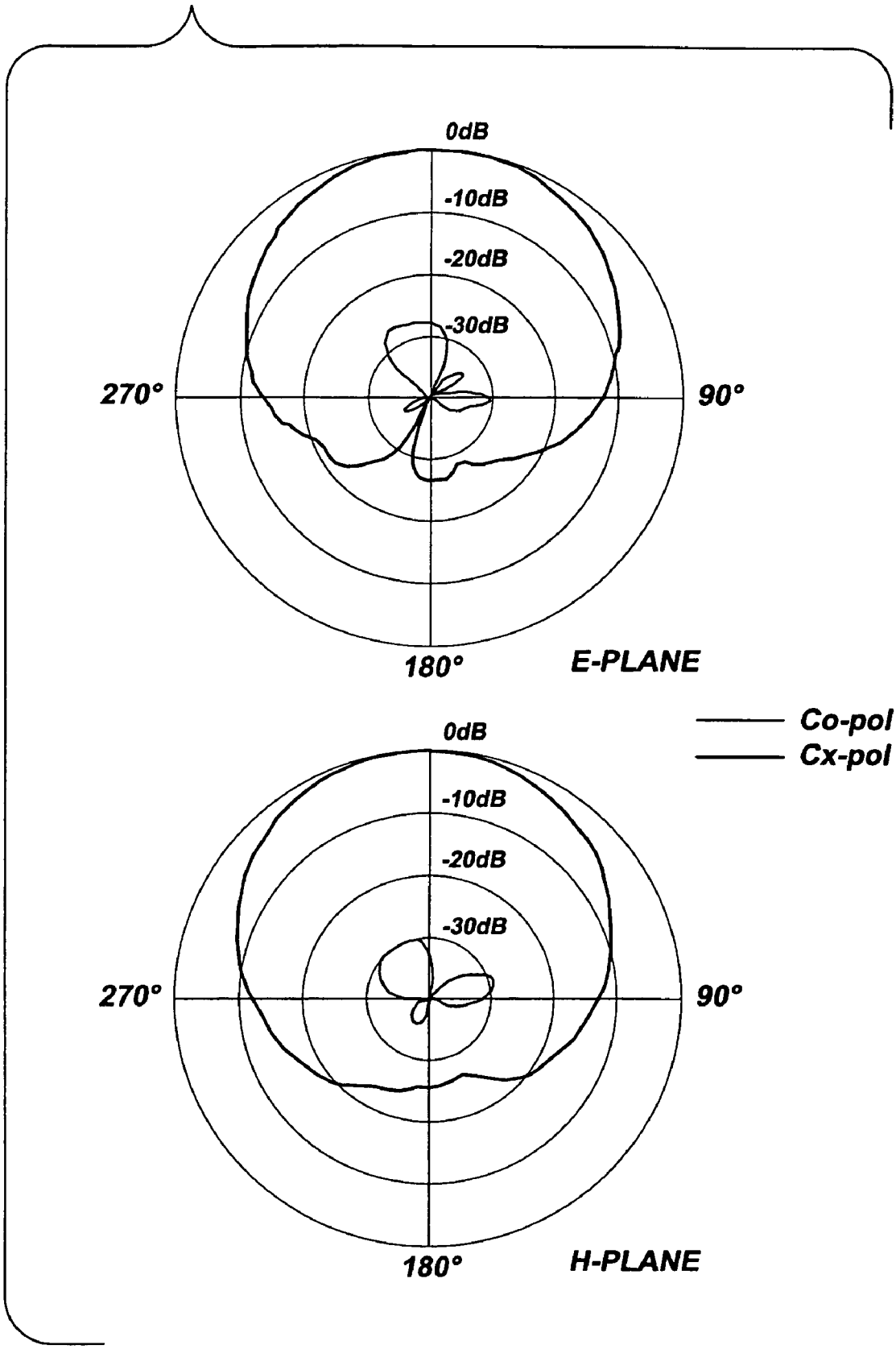
Figure 3C:
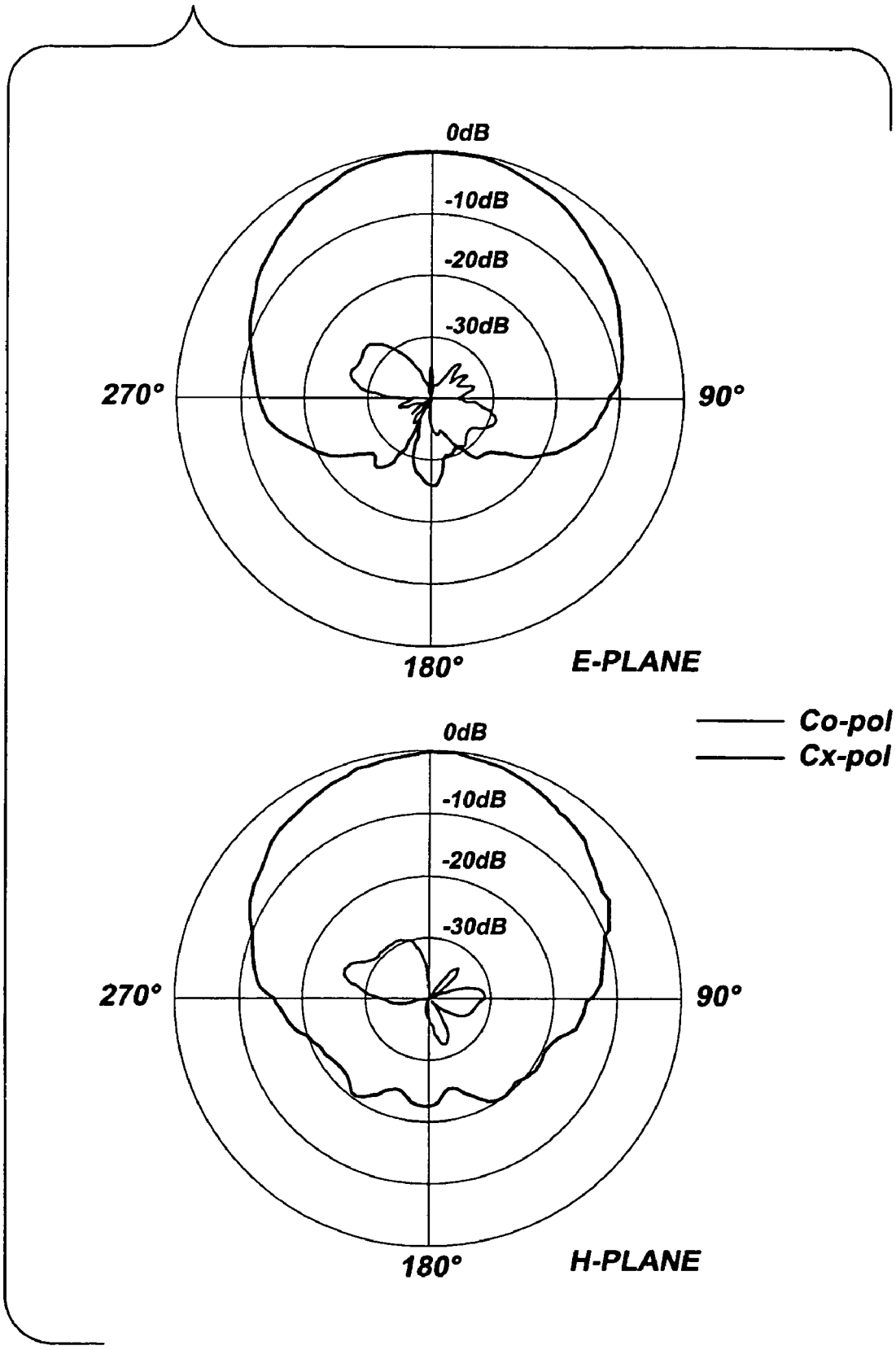

FIGS. 3(*a*)-(*c*) show measured radiation patterns at respectively 1.75 GHz, 2.5 GHz and 3.0 GHz. In both the E and H planes the broadside radiation patterns are stable and symmetrical. At the frequency of 2.5 GHz, the H-plane beam width is 79° which is slightly higher than the E-plane beam width of 75°. Low cross polarization and low back radiation are observed across the entire operating bandwidth.

Figure 4A:
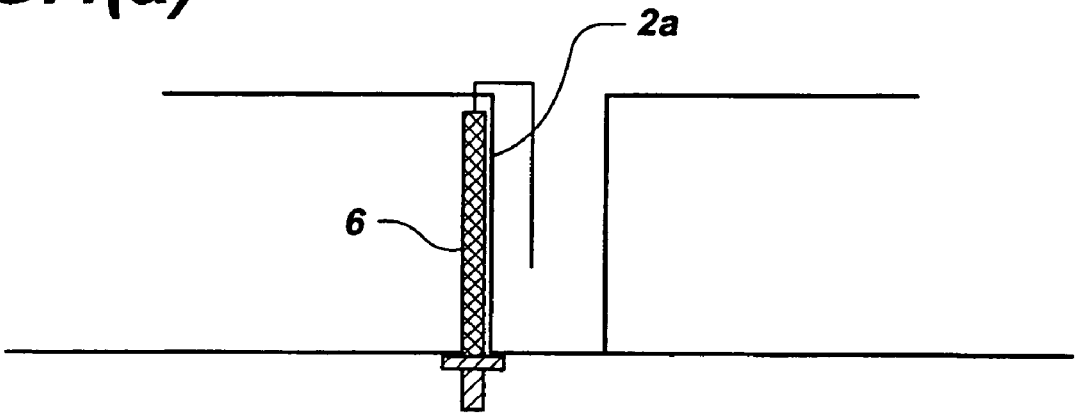
Figure 4B:
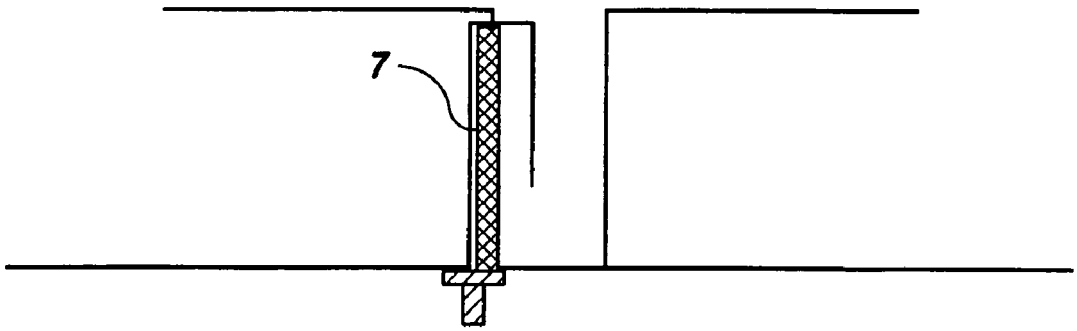

The feed for the antenna may take a number of different forms in addition to the Γ-shaped probe shown in FIG. 1. FIG. 4(*a*) shows a first possibility in which the first portion 4*a* of the probe of FIG. 1 is removed and the second portion is instead connected directly to the center conductor of a coaxial cable 6 which may be located inside or outside of the vertical wall 2*a* of the patch antenna. In FIG. 4(*a*) the coaxial cable 6 is located outside of the vertical wall 2*a*. Instead of using coaxial cable 6, other forms of transmission lines may be used such as a microstrip line 7 as shown in FIG. 4(*b*).

Figure 5A:
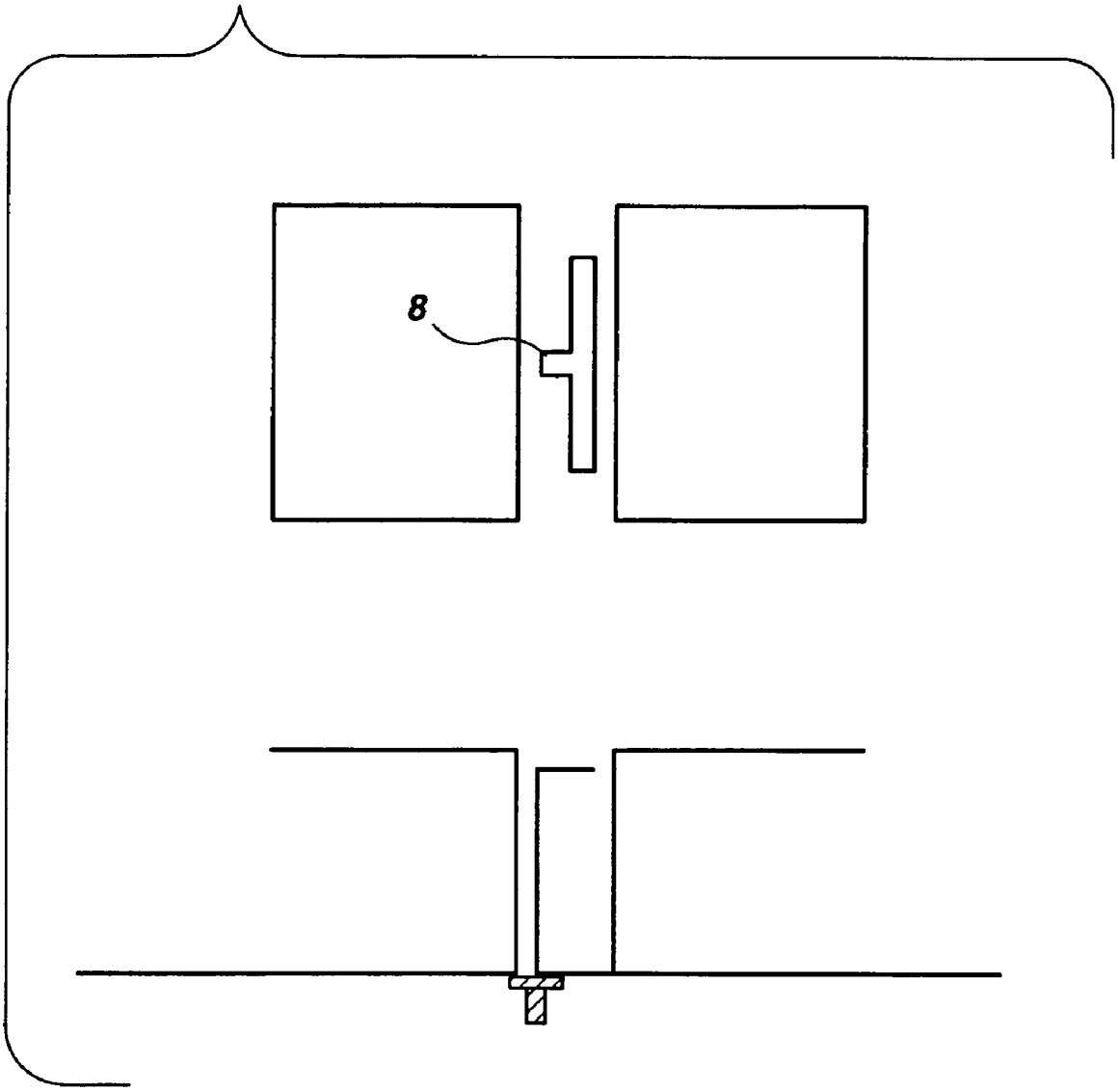
Figure 5B:
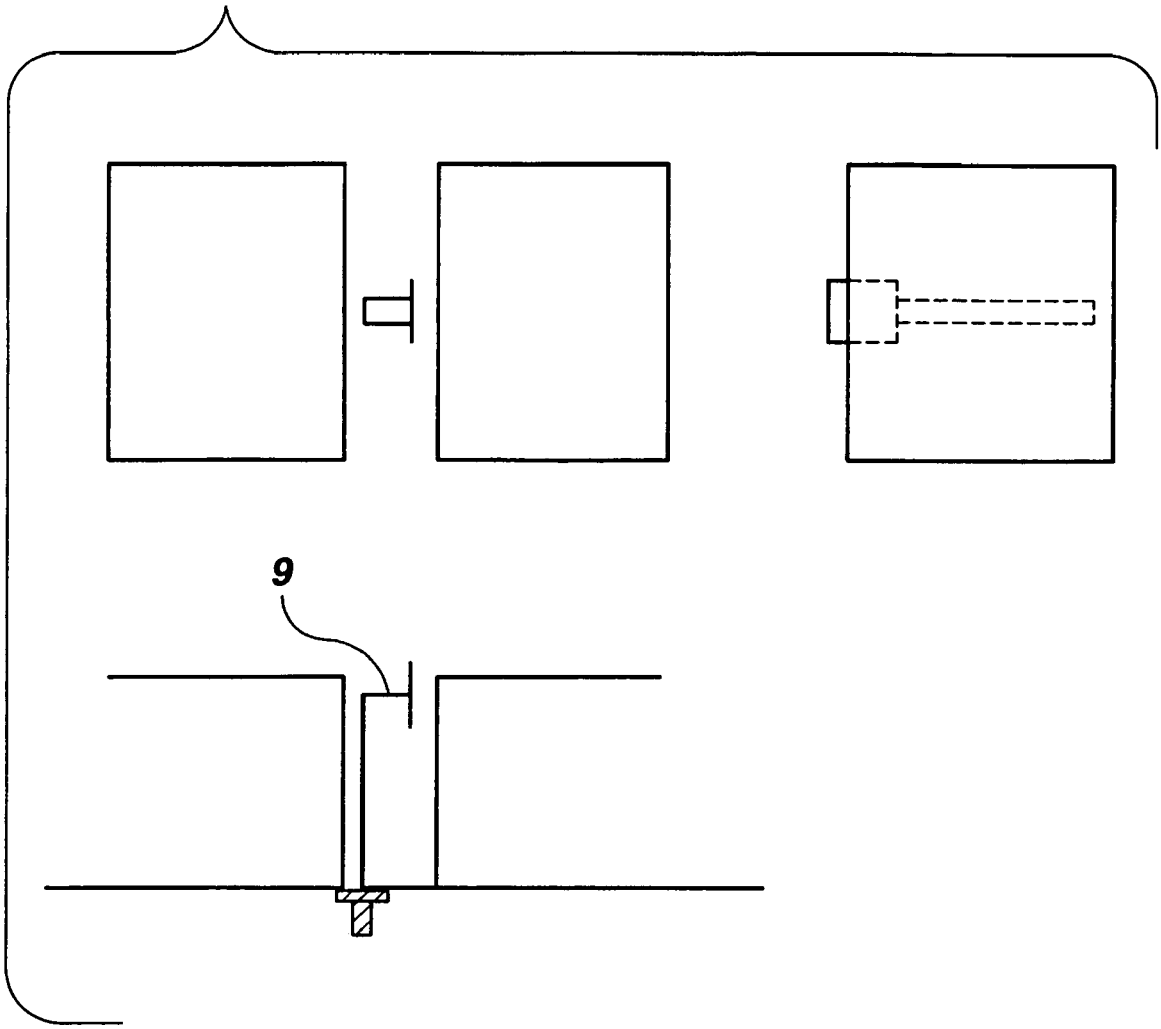
Figure 5C:
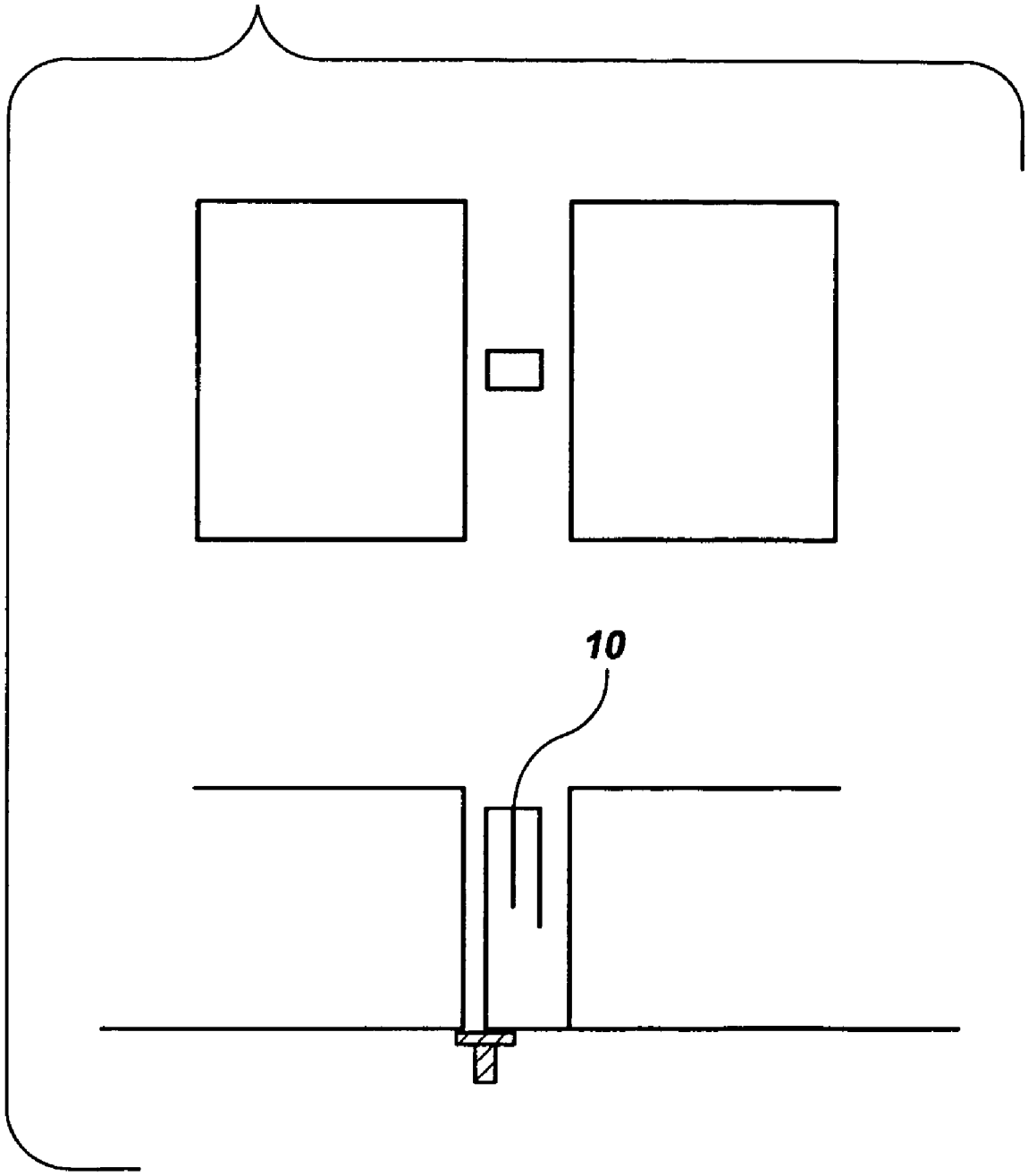
Figure 6:
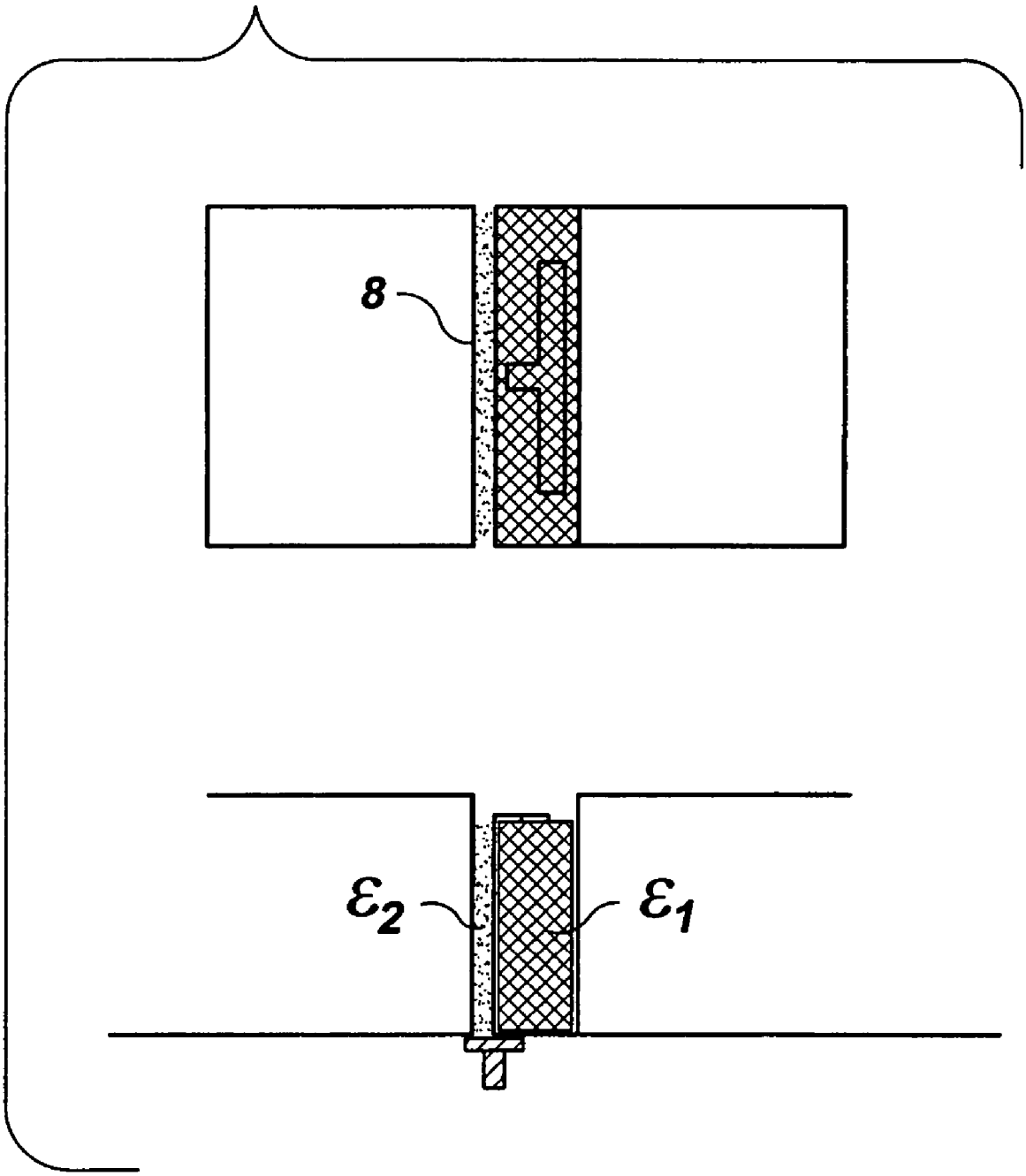
FIG. 6 shows top and side views of an example embodiment of the invention with an electrically loaded T-shaped coupling feed, FIGS. 7(*a*)-(*d*) show top views of example alternative shapes for the dipole, FIGS. 8(*a*) and (*b*) show side views of example alternative profiles for the dipole, FIGS. 9(*a*)-(*c*) show side views of example alternative methods for constructing the antenna, FIGS. 10(*a*)-(*e*) show side views of example alternative shapes for the vertical sections of the shorted patch antenna.
Figure 7:
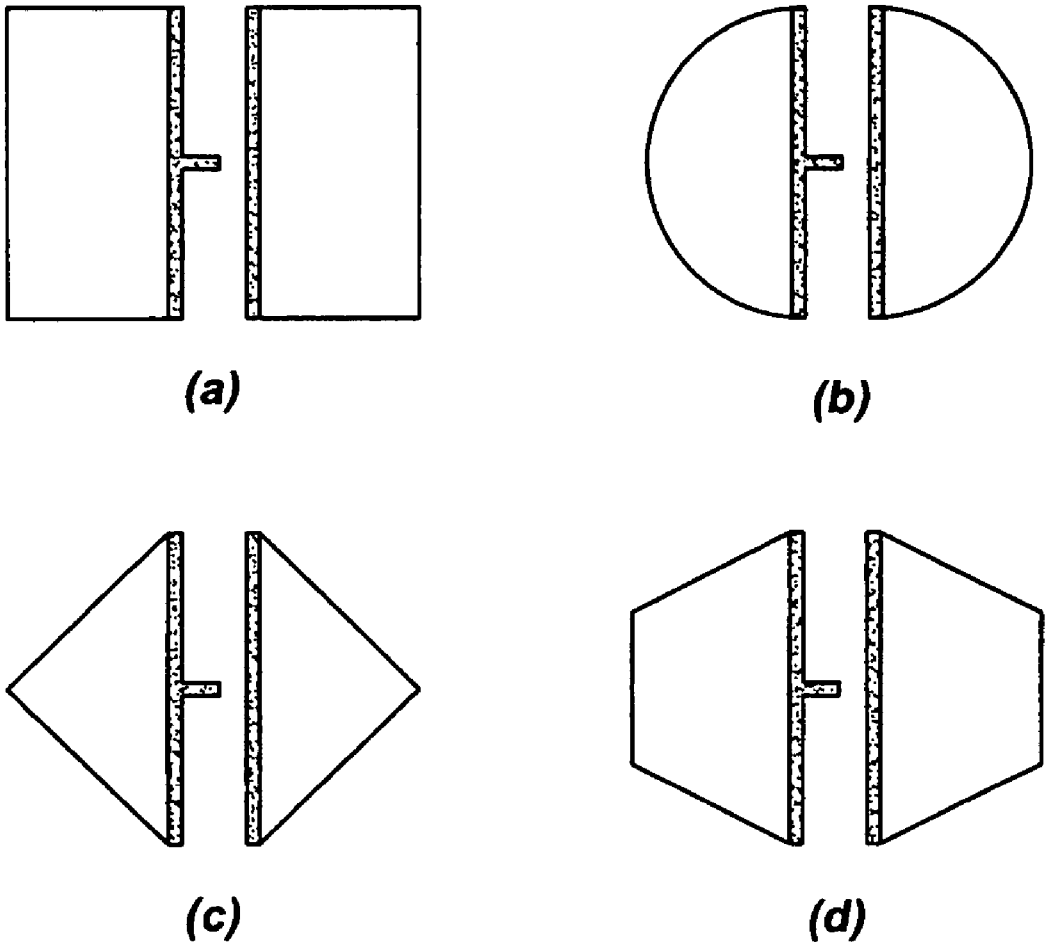

In both embodiments FIGS. 4(*a*) and (*b*) the feed probe becomes an L-shaped probe formed by the second and third portions of the probe shown in FIG. 1. Other possibilities include replacing the second and third portions 4*b*, 4*c* of the feed probe shown in FIG. 1 with a T-shaped structure 8 as shown in FIG. 5(*a*), a capacitive structure 9 as shown in FIG. 5(*b*) or an F-shaped structure 10 as shown in FIG. 5(*c*). The height of the antenna may be reduced by loading the antenna with dielectric materials between the vertical portions of the patch antenna as shown in FIG. 6. Other design possibilities for optimizing performance of the antenna for particular circumstances include using different shapes for the dipole sections as are shown in FIG. 7. The dipole sections could, for example, be (*a*) rectangular, (*b*) semi-circular, (*c*) triangular or (*d*) polygonal.

Figure 8A:
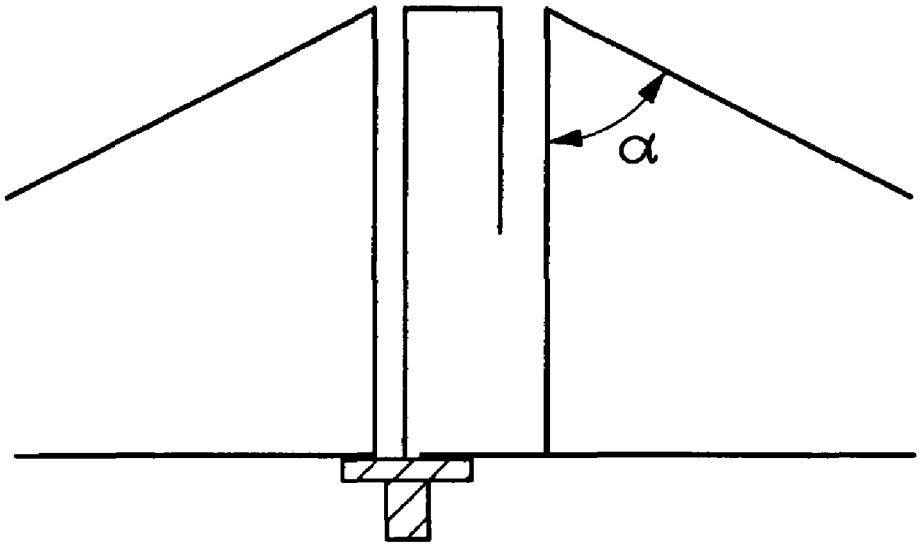
Figure 8B:
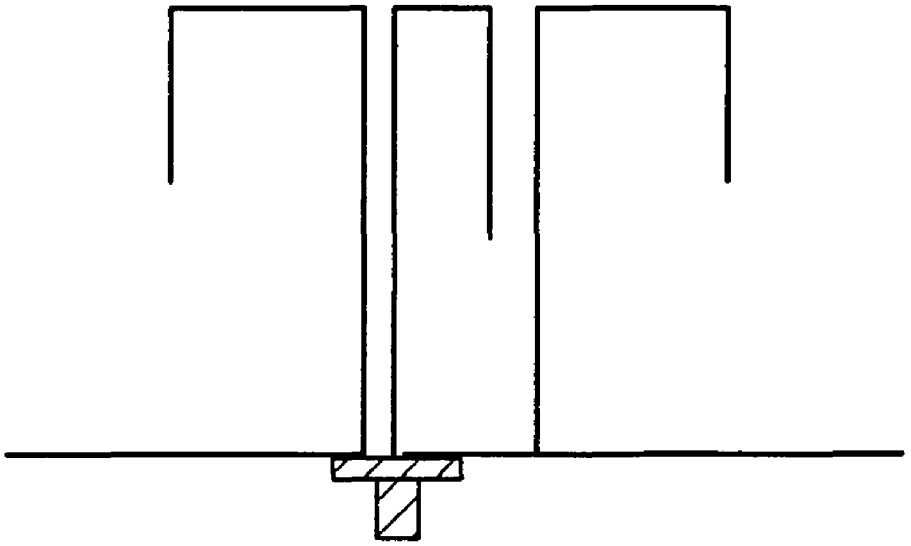

The size of the antenna may also be reduced by folding the dipole sections as shown in FIGS. 8(*a*) and (*b*). In FIG. 8(*a*) instead of being parallel to the ground plane, as in FIG. 1, the dipole sections are angled towards the ground plane by an angle α. In FIG. 8(*b*) the dipole sections are folded so that they comprise a horizontal section parallel to the ground plane, and a vertical section perpendicular to the ground plane. It will be understood that FIGS. 8(*a*) and (*b*) may be combined so that the dipole sections still include a clear fold, but either the "parallel" or "perpendicular" dipole sections may be angled to the vertical or horizontal.

Figure 9:
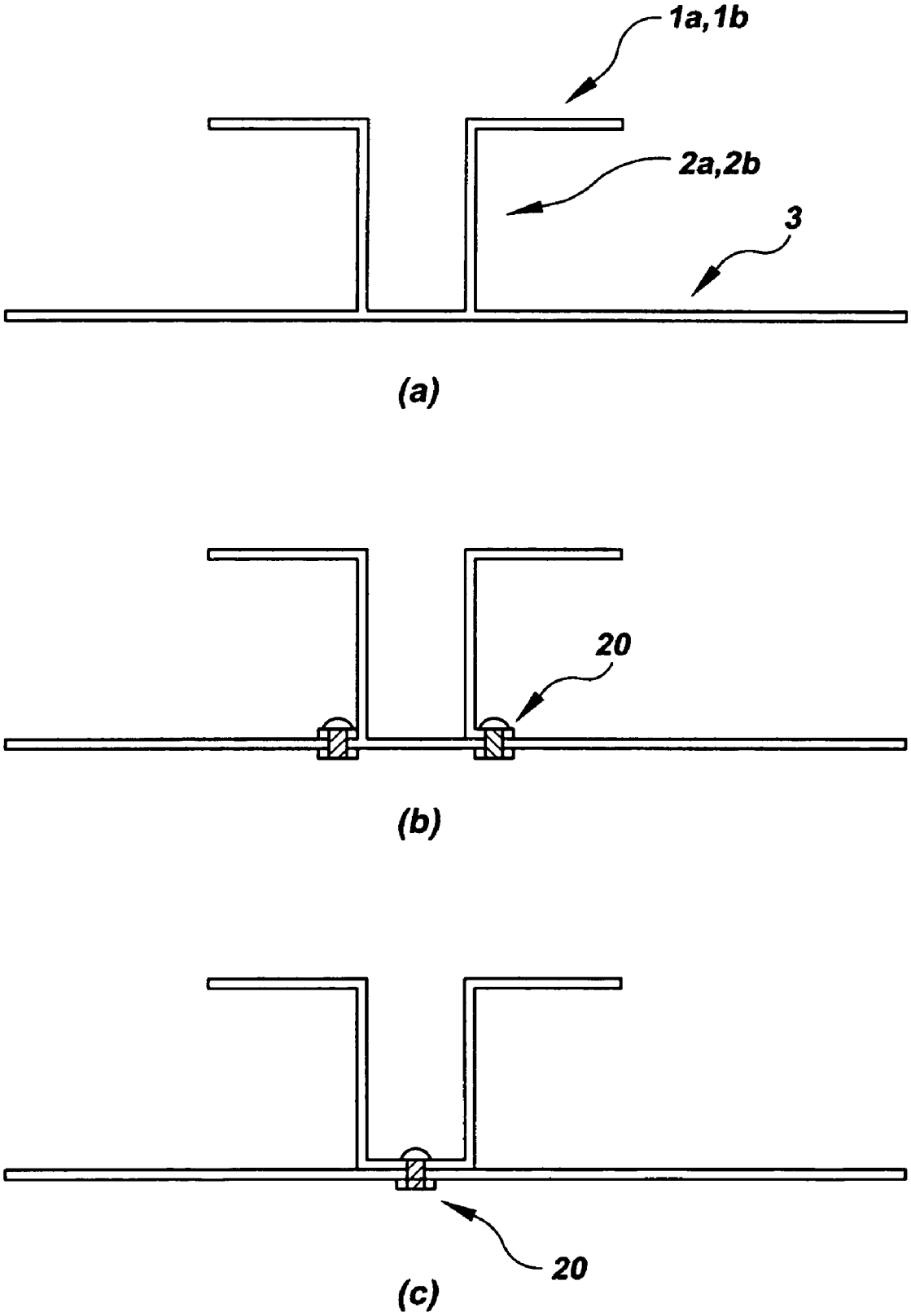

The antenna can be constructed in a number of different ways as shown in FIGS. 9(*a*)-(*c*). For example the antenna may be integrally formed as shown in FIG. 9(*a*) with the dipole sections 1*a*, 1*b*, vertical sections 2*a*, 2*b*, horizontal section 2*c* and the ground plane 3 all being formed as an integral whole. An alternative possibility is shown in FIG. 9(*b*) where one dipole section 1*a* and one vertical section 2*a* are formed integrally, the other dipole section 1*b* and the other vertical section 2*b* are also formed integrally, and then the integral dipole section/vertical sections are secured to the ground plane by screws 20 or other fixing mechanism. FIG. 9(*c*) shows a further possibility in which the dipole sections 1*a*, 1*b*, vertical sections 2*a*, 2*b* and horizontal section 2*c* are all formed integrally and are fixed to the ground plane 3 by screw 20 or other fastening means.

Figure 10:
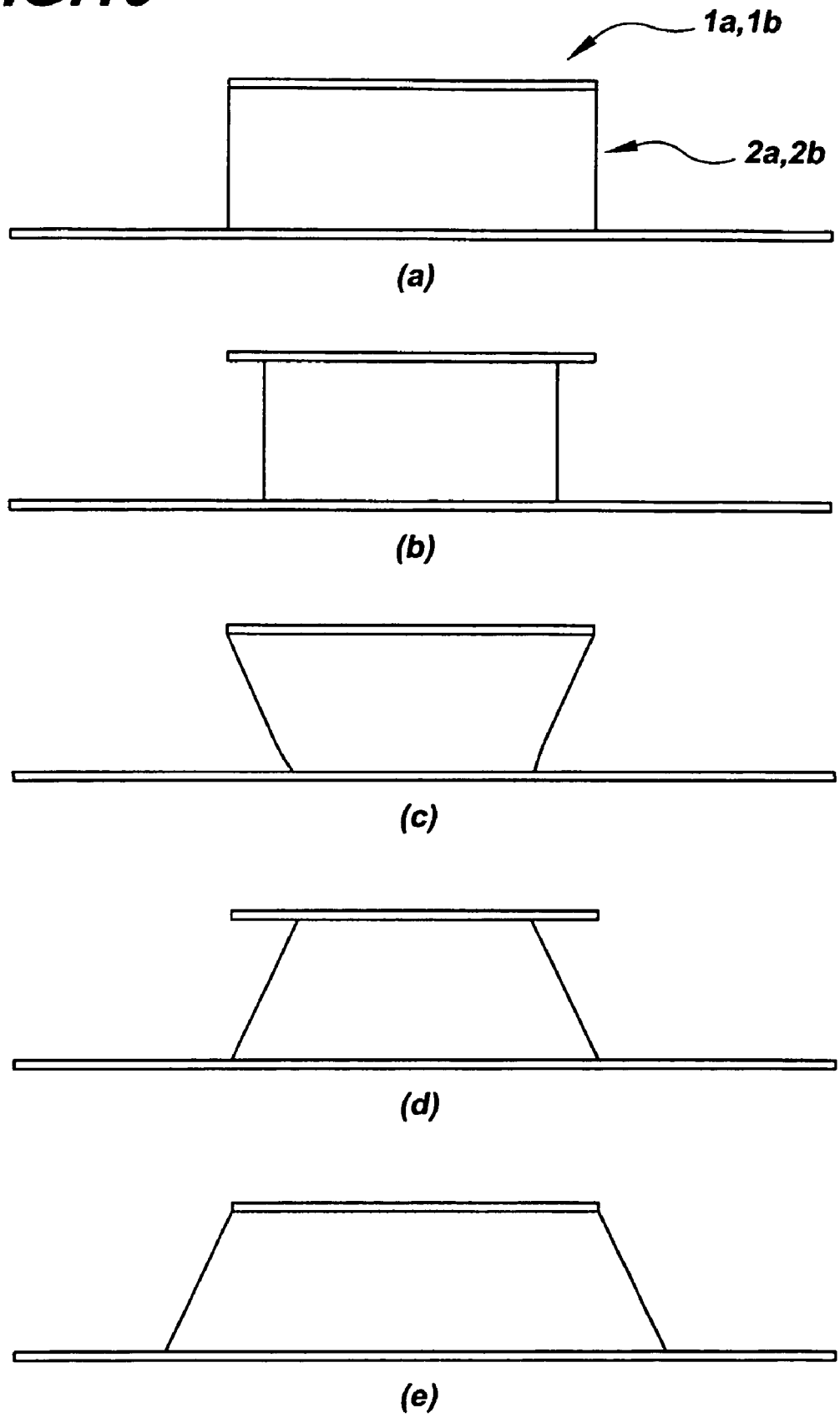

FIGS. 10(*a*)-(*e*) show various possible shapes for the vertical sections 2*a*, 2*b*. In FIG. 10(*a*) the vertical sections 2*a*, 2*b* are rectangular and are the sane width as the dipole sections 1*a*, 1*b*. In FIG. 10(*b*) the vertical sections 2*a*, 2*b* are rectangular but slightly narrower in width than the dipole sections 1*a*, 1*b*. In FIG. 10(*c*) the vertical sections are trapezoidal and taper from the width of the dipole sections 1*a*, 1*b* where they contact the dipole sections 1*a*, 1*b* to a narrower width at the ground plane. In FIG. 10(*d*) the vertical sections 2*a*, 2*b* are trapezoidal and taper from a width at the ground plane equal to the width of the dipole sections, to a narrower width at the dipole sections. Finally, in FIG. 10(*e*) the vertical sections are again trapezoidal with a width at the dipole sections equal to the width of the dipole sections, and a greater width at the ground plane.

Figure 11:
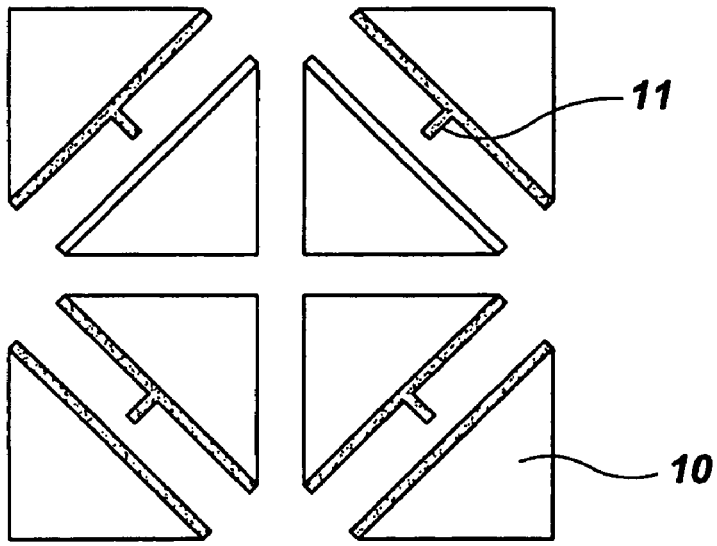
FIG. 11 shows a top view of one example of an embodiment of the invention in the form of a dual polarization antenna.
Figure 12:
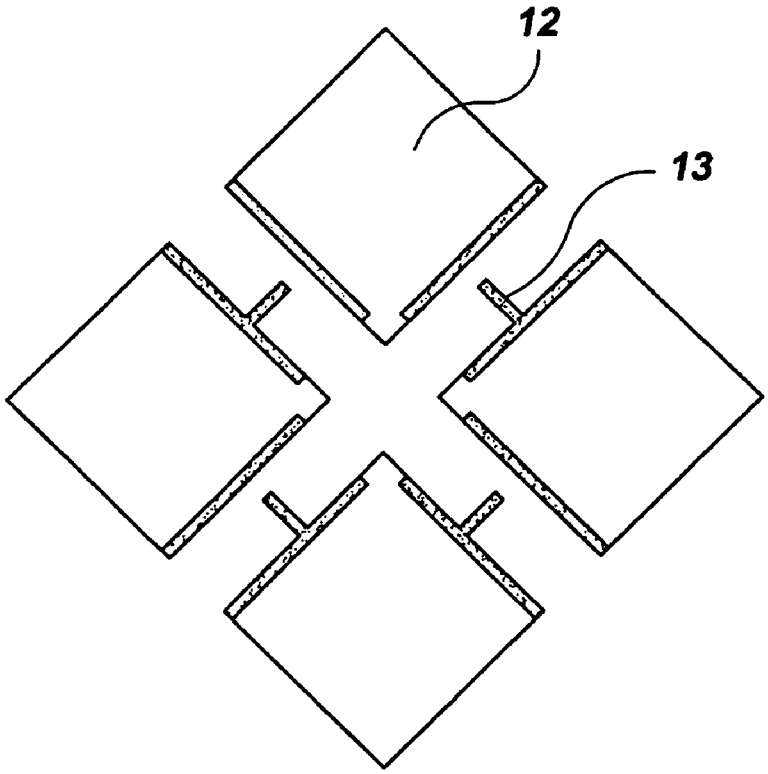
FIG. 12 shows a top view of one example of an alternative configuration of a dual polarization antenna.

For use in applications requiring dual-polarization, an array of antennas according to embodiments of the invention may be provided. FIG. 11 is a plan view showing a particularly convenient structure in which four antenna are provided arranged into a square and with each being formed with triangular dipole sections 10 and a feed 11. The structure of FIG. 11 using triangular dipole sections is particularly compact, but an alternative possibility is shown in FIG. 12 in which an array of four antennas is provided also arranged in a square, but with each antenna being formed on two square dipole sections 12 with a feed 13. It will be understood that other arrays may be provided using different numbers of antennas, different types of antenna and in different configurations.

At least in its preferred forms an antenna according to embodiments of the present invention has excellent electrical parameters such as low back radiation, low cross polarization, a symmetrical radiation pattern, and is stable in gain and radiation pattern shape over the frequency bandwidth. In particular the low back radiation characteristic makes it highly attractive for the development of various kinds of indoor and outdoor base station antennas for modern cellular communication systems since the potential interference between different cells operating at the same frequency can be reduced. The antenna is simple in structure and therefore low in manufacturing costs. The antenna can also be used as a basic element in the design of low cost high performance antenna arrays with different gain and beam widths.

It will be understood that in this specification and the following claims the terms "vertical" and "horizontal" are used for convenience and clarity of description and assume that the ground plane occupies a horizontal plane. The use of these and similar terms should not be taken as implying any limitation on the orientation of the antenna.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. A wideband antenna comprising:

a planar dipole formed of two dipole sections and a shorted patch antenna element located between said dipole sections, said dipole sections being spaced a distance above a ground plane, wherein said shorted patch antenna element comprises first and second parallel vertical sections extending respectively from an edge of a respective dipole section to said ground plane, and a feed probe located between said vertical sections of said shorted patch antenna element.

2. An antenna as claimed in claim 1 wherein said vertical sections are rectangular.

3. An antenna as claimed in claim 2 wherein said rectangular vertical sections have a width equal to a width of said respective dipole sections.

4. An antenna as claimed in claim 2 wherein said rectangular vertical sections have a width less than a width of said respective dipole sections.

5. An antenna as claimed in claim 2 wherein said vertical sections are trapezoidal.

6. An antenna as claimed in claim 5 wherein said trapezoidal vertical sections have one side with a width equal to a width of said respective dipole sections.

7. An antenna as claimed in claim 1 wherein said feed probe comprises a first section extending vertically with respect to the ground plane parallel and proximate to said first vertical section of said shorted patch antenna, a second section extending parallel to said ground plane, and a third section extending towards said ground plane.

8. An antenna as claimed in claim 7 wherein said second section of said feed probe is spaced from said ground plane by the same distance as said dipole sections.

9. An antenna as claimed in claim 7 wherein said third section extends proximate and parallel to the second vertical section of the shorted patch antenna or at a small angle thereto.

10. An antenna as claimed in claim 1 wherein said feed probe comprises a coaxial feed extending from the ground plane substantially to the spacing of said dipole sections from said ground plane, and a probe comprising a portion extending parallel to said ground plane and a portion extending towards said ground plane and substantially perpendicular thereto.

11. An antenna as claimed in claim 1 wherein said feed probe comprises a microstrip transmission line extending from the ground plane substantially to the spacing of said dipole sections from said ground plane, and a probe comprising a portion extending parallel to said ground plane and a portion extending towards said ground plane and substantially perpendicular thereto.

12. An antenna as claimed in claim 1 wherein said feed probe comprises a first section extending perpendicularly to said ground plane and parallel to said first vertical section of said shorted patch antenna, and a second section extending parallel to said ground plane, said second section having a T-shape.

13. An antenna as claimed in claim 1 wherein said feed probe comprises a first section extending perpendicularly to said ground plane and parallel to said first vertical section of said shorted patch antenna, a second section extending parallel to said ground plane, and two vertical sections extending from said second section towards said ground plane.

14. An antenna as claimed in claim 1 wherein said dipole sections are rectangular.

15. An antenna as claimed in claim 1 wherein said dipole sections are polygonal.

16. An antenna as claimed in claim 1 wherein said dipole sections are triangular.

17. An antenna as claimed in claim 1 wherein said dipole sections are semi-circular.

18. An antenna as claimed in claim 1 further comprising dielectric material disposed in a space defined by said shorted patch antenna.

19. An antenna as claimed in claim 1 wherein said dipole sections are parallel to said ground plane.

20. An antenna as claimed in claim 1 wherein at least a portion of each of said dipole sections is angled relative to said ground plane.

21. An antenna as claimed in claim 1 wherein each of said dipole sections comprises a portion parallel to said ground plane and a portion perpendicular to said ground plane.

* * * * *